US007107907B2

(12) United States Patent
Vrotacoe

(10) Patent No.: US 7,107,907 B2
(45) Date of Patent: Sep. 19, 2006

(54) FLOW-RESTRICTED PRINTING CYLINDER FOR A REMOVABLE PRINTING SLEEVE

(75) Inventor: James Brian Vrotacoe, Rochester, NH (US)

(73) Assignee: Goss International Americas, Inc., Dover, NH (US)

( * ) Notice: Subject to any disclaimer, the term of this patent is extended or adjusted under 35 U.S.C. 154(b) by 839 days.

(21) Appl. No.: 09/767,108

(22) Filed: Jan. 22, 2001

(65) Prior Publication Data

US 2002/0096073 A1 Jul. 25, 2002

(51) Int. Cl.
*B41F 33/00* (2006.01)

(52) U.S. Cl. ..... 101/483; 101/382.1

(58) Field of Classification Search ..... 101/378, 101/375, 368, 382.1, 483
See application file for complete search history.

(56) References Cited

U.S. PATENT DOCUMENTS

| | | | | |
|---|---|---|---|---|
| 2,828,553 | A | 4/1958 | Jarosz | 34/122 |
| 4,030,415 | A * | 6/1977 | Fellows | 101/382.1 |
| 4,150,622 | A * | 4/1979 | Stollenwerk et al. | |
| 4,398,563 | A * | 8/1983 | Kay et al. | 138/42 |
| 4,903,597 | A * | 2/1990 | Hoage et al. | 101/401.1 |
| 5,215,013 | A | 6/1993 | Vrotacoe et al. | 101/217 |
| 5,398,604 | A * | 3/1995 | Burke et al. | 101/216 |
| 5,544,584 | A * | 8/1996 | Thompson et al. | 101/401.1 |
| 5,595,115 | A * | 1/1997 | Rau et al. | 101/142 |
| 5,735,206 | A * | 4/1998 | Rossini | 101/216 |
| 5,797,531 | A | 8/1998 | Marmin | 226/97 |
| 5,819,657 | A * | 10/1998 | Rossini | 101/376 |
| 5,983,799 | A * | 11/1999 | Lane et al. | 101/375 |
| 6,186,068 | B1 * | 2/2001 | Gelbart | 101/486 |
| 6,347,586 | B1 * | 2/2002 | Boucher et al. | 101/382.1 |
| 6,360,662 | B1 * | 3/2002 | Busshoff | 101/375 |
| 6,401,613 | B1 * | 6/2002 | Gayle et al. | 101/375 |
| 6,581,517 | B1 * | 6/2003 | Becker et al. | 101/389.1 |

FOREIGN PATENT DOCUMENTS

EP 0510744 10/1992

(Continued)

OTHER PUBLICATIONS

Glasgow Products Inc. Brochure "feather flite—Air Conveying Systems" 4 pages.

*Primary Examiner*—Anthony H. Nguyen
(74) *Attorney, Agent, or Firm*—Davidson, Davidson & Kappel, LLC

(57) ABSTRACT

A printing cylinder for accepting an axially-removable printing sleeve includes a cylinder body having an outer surface, the outer surface having at least one hole and a supply line in the cylinder body for supplying fluid to the at least one hole. The supply line has at least one flow restrictor designed to alter fluid flow as a function of the at least one hole being covered by an axially-removable printing sleeve. Also provided is a printing press having two such cylinders and a common pressure source. A method for axially removing a printing sleeve over a printing cylinder includes the steps of applying fluid pressure to an inside of a printing sleeve located on a printing cylinder through holes at a work side end of the printing cylinder and through other holes between the holes at the work side end and a gear side end of the printing cylinder, sliding the printing sleeve in a direction of the work side end of the printing cylinder, and automatically restricting flow through the other holes when the printing sleeve no longer is located over the other holes.

20 Claims, 7 Drawing Sheets

FOREIGN PATENT DOCUMENTS

| | | |
|---|---|---|
| EP | 0987109 | 3/2000 |
| WO | 9104155 | 4/1991 |

* cited by examiner

FLOW-RESTRICTED PRINTING CYLINDER FOR A REMOVABLE PRINTING SLEEVE

BACKGROUND INFORMATION

1. Field of the Invention

The present invention relates generally to printing presses and more particularly to printing presses having printing sleeves that are placed on or removed from a cylinder with the aid of air or other fluid pressure.

2. Background of the Invention

Tubular-shaped printing sleeves, such as offset lithographic printing blankets described in U.S. Pat. No. 5,215,013, are placed and removed axially over a printing cylinder. As described with respect to a blanket in the '013 patent, air holes typically are located on a work side end of the blanket cylinder to provide pressure to the inside of the blanket as the blanket is removed or placed axially over the blanket cylinder.

However, blankets can become stuck when mounted for too long, as air pressure from the air holes can be blocked and not reach the gear side end of the cylinder. Moreover, the use of only one set of air holes on the work side end makes hole placement critical, or the sleeve will not inflate or expand at all. With improperly placed holes, the air may simply rush out of the work side end without inflating the gear side end.

Also, it may be desirable to place multiple blankets side-by-side over a single blanket cylinder. A single set of work side holes can inflate only one of the blankets at the work side, thus not permitting the other blankets closer to the gear side to be removed.

It has been attempted to place additional air holes along the length of the body of the printing cylinder. However, when the sleeve is in a partially removed or placed position, these air holes remain uncovered while the work side air holes are covered. A large pressure reduction results as the air rushes out the uncovered holes and the flow drops at the work side holes, thus making blanket placement or removal difficult or impossible. Thus the additional holes require the use of multiple plumbing fixtures, solenoids and valves to control the air flow properly. These features tend to be expensive and are complicated, especially because the cylinder must rotate.

In a 1981 textbook entitled, *Beruehrungsfreie Dichtungen* (Contactless Seals), the authors describe labyrinth seals, in which fluid flow can be blocked or reduced using vortices. In FIG. 3-56 at pages 174–176, the effect of placement of fins on air flow and vortex generation is shown. However, the use of these seals in printing machines or for printing cylinders is not discussed.

SUMMARY OF THE INVENTION

An object of the present invention is to provide a printing cylinder that can accommodate the fluid-assisted removal or placement of more than one printing sleeve. An alternate or additional object of the present invention is to improve the fluid-assisted removal or placement of a printing sleeve.

The present invention provides a printing cylinder for accepting an axially-removable printing sleeve comprising a cylinder body having an outer surface, the outer surface having at least one hole and a supply line in the cylinder body for supplying fluid to the at least one hole. The supply line has at least one flow restrictor designed to alter fluid flow as a function of the at least one hole being covered by an axially-removable printing sleeve.

The fluid preferably is air, and the flow restrictor preferably forms vortices when the at least one hole in uncovered.

The outer surface may have a plurality of other holes at a work side end of the printing cylinder, with the at least one hole located axially between the other holes and a gear side end of the printing cylinder. The plurality of other holes may include another supply line having at least one other flow restrictor for the other holes.

The flow restrictor preferably includes a plurality of opposing fins, tips of opposing fins being spaced so as to form a free-flow channel.

The at least one hole preferably includes a plurality of holes, with the at least one flow restrictor including a flow restrictor for each hole.

The outer surface may include a second set of holes for a second axially-removable printing sleeve, the second set of holes having second flow restrictors.

The present invention also provides a printing press comprising a first printing cylinder having at least one external hole and a first flow restrictor, a first axially removable printing sleeve fitting over the first printing cylinder, a second printing cylinder having at least one second external hole and a second flow restrictor, a second axially removable printing sleeve fitting over the second printing cylinder, and a fluid supply source for supplying pressure to the first and second external holes. The first flow restrictor restricts flow through the external hole as a function of an axial position of the first printing sleeve with respect to the first printing cylinder and the second flow restrictor restricts flow through the second external hole as a function of an other axial position of the second printing sleeve with respect to the second printing cylinder.

Advantageously, complicated valves are not required between the first and second external holes.

The printing press preferably is an offset lithographic printing press, and the first printing cylinder a blanket cylinder.

Also provided is a method for axially removing a printing sleeve over a printing cylinder comprising the steps of applying fluid pressure to an inside of a printing sleeve located on a printing cylinder through holes at a work side end of the printing cylinder and through other holes between the holes at the work side end and a gear side end of the printing cylinder, sliding the printing sleeve in a direction of the work side end of the printing cylinder, and automatically restricting flow through the other holes when the printing sleeve no longer is located over the other holes.

BRIEF DESCRIPTION OF THE DRAWINGS

Several preferred embodiments of the present invention will be described in more detail with reference to the figures, in which.

DETAILED DESCRIPTION OF THE PREFERRED EMBODIMENTS

Figure 1:
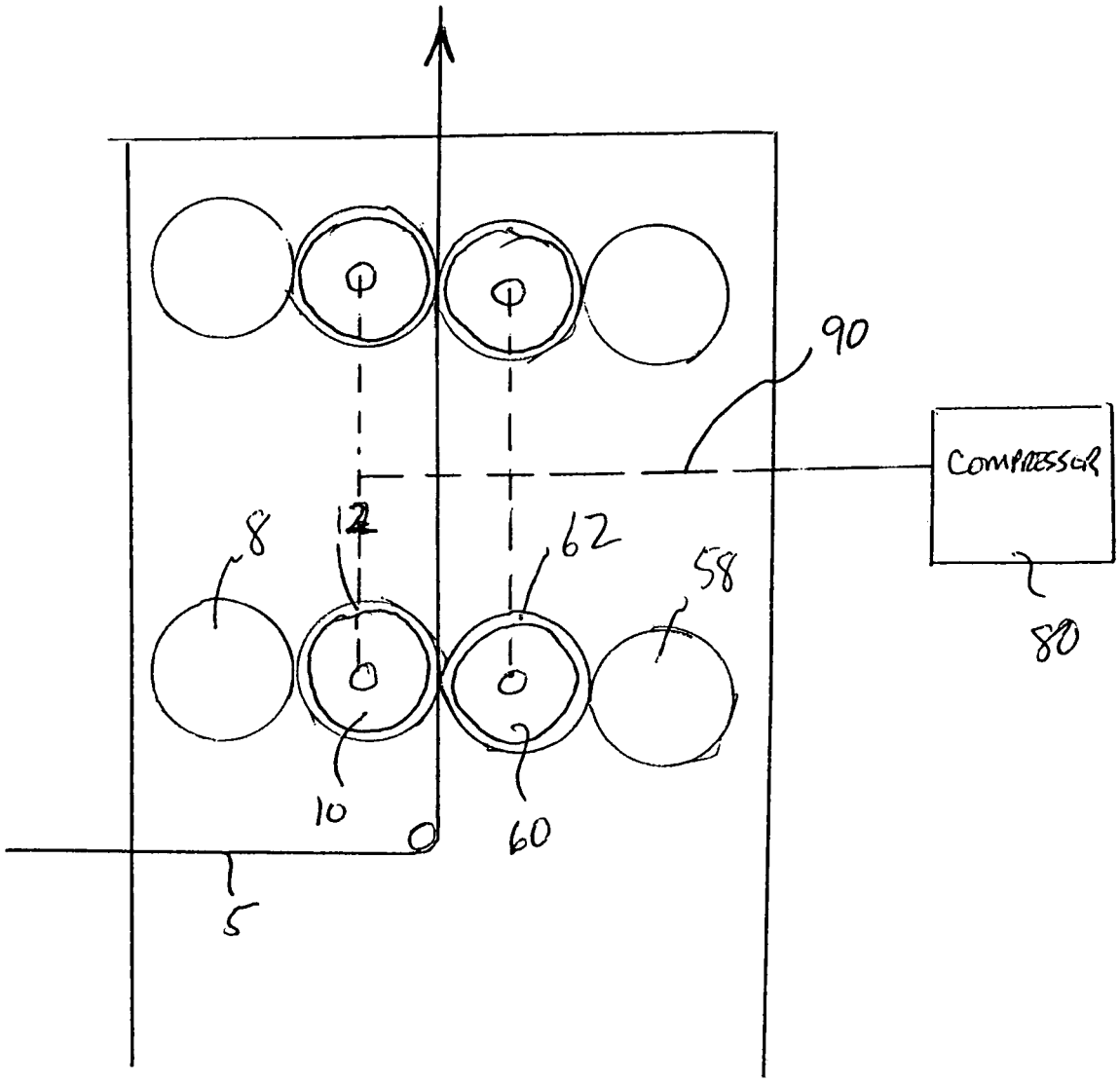
FIG. 1 shows schematically an offset lithographic printing press according to the present invention in which a single air source, such as a compressor, feeds four different blanket cylinders according to the present invention.

FIG. 1 shows schematically a gear side view of a lithographic offset printing press 1 according to the present invention. A web 5 passes between a nip formed by a first sleeve-shaped blanket 12 and a second sleeve-shaped blanket 62, and then through a second nip formed by a third sleeve-shaped blanket 112 and a fourth sleeve-shaped blanket 162. Blanket 12 is mounted axially on a blanket cylinder 10 having flow restrictors, as will be described with respect to FIG. 2, and blanket 62 is mounted axially on a similar blanket cylinder 59. Plate cylinders 8, 58 contact blankets 12, 62, respectively, to provide an inked image to the blankets, the image then being transferred to the web 5.

The blankets 12, 62, 112, 162 are axially removable through openings in the work side frame of the printing press 1, with the aid of air pressure supplied through holes in the blanket cylinders 10, 60, 110, 160, respectively. A compressor 80 feeds air through a feed line 90 to the blanket cylinders 12, 62, 112, 162. Preferably, no valves or cutoff devices are placed in the feed line 90, and thus air pressure is supplied to all four cylinders 10, 60, 110, 160 at the same time.

Figure 2:
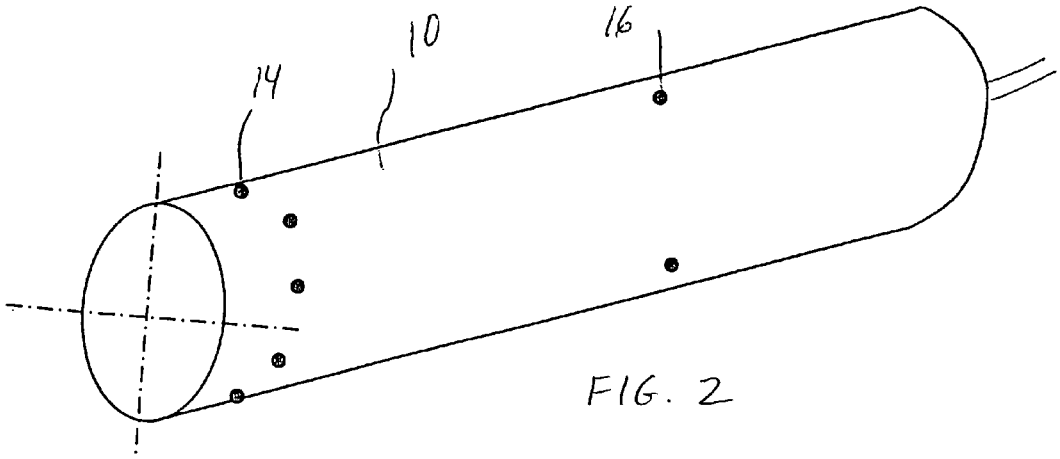
FIG. 2 shows a blanket cylinder for a single blanket according to the present invention.

FIG. 2 shows one of the blanket cylinders 10 having a plurality of air holes or nozzles 14 at a work side end of the blanket cylinder 10. When the blanket 12 is removed from or placed on cylinder 10, these holes 14 typically are covered except when the blanket is fully removed. In order to aid in removing and placing the blanket 12 over the cylinder 10, an additional set of flow restricted holes or nozzles 16 is provided. The holes 16 are placed axially between the first set of work side holes 14 and the gear side end of the cylinder. Preferably, the additional holes 16 include at least one hole spaced closer to the gear side end of the cylinder than to the work side end.

Figure 4A:
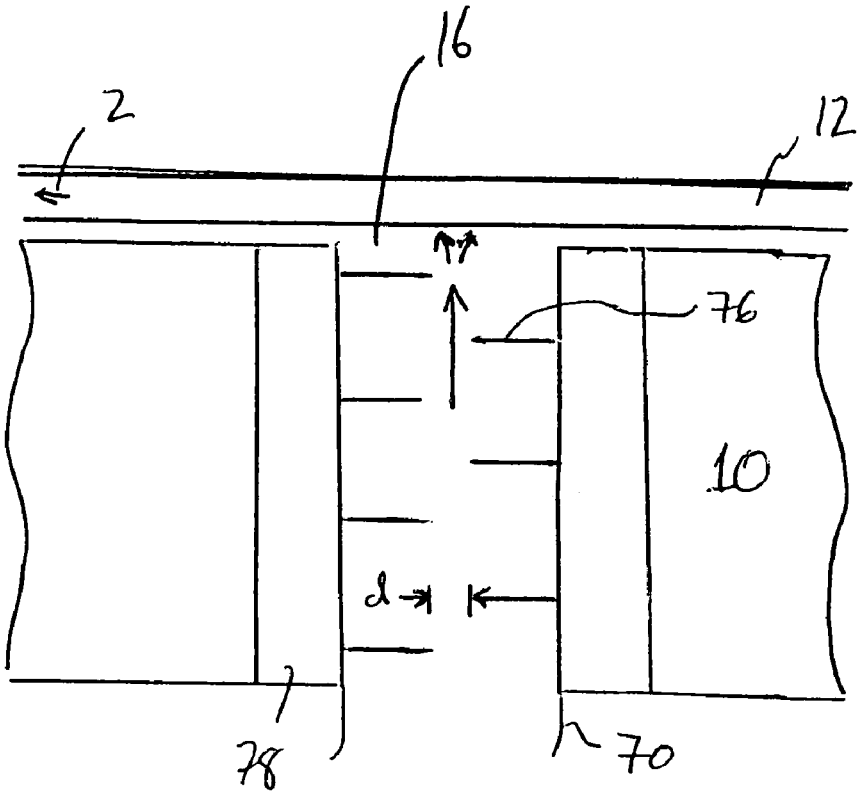
FIGS. 4*a* and 4*b* show a first embodiment of a flow restrictor for the flow restricted air holes of the cylinder according to the present invention, with a blanket being located over the hole in FIG. 4*a* and the blanket not being located over the hole in FIG. 4*b*.
Figure 4B:
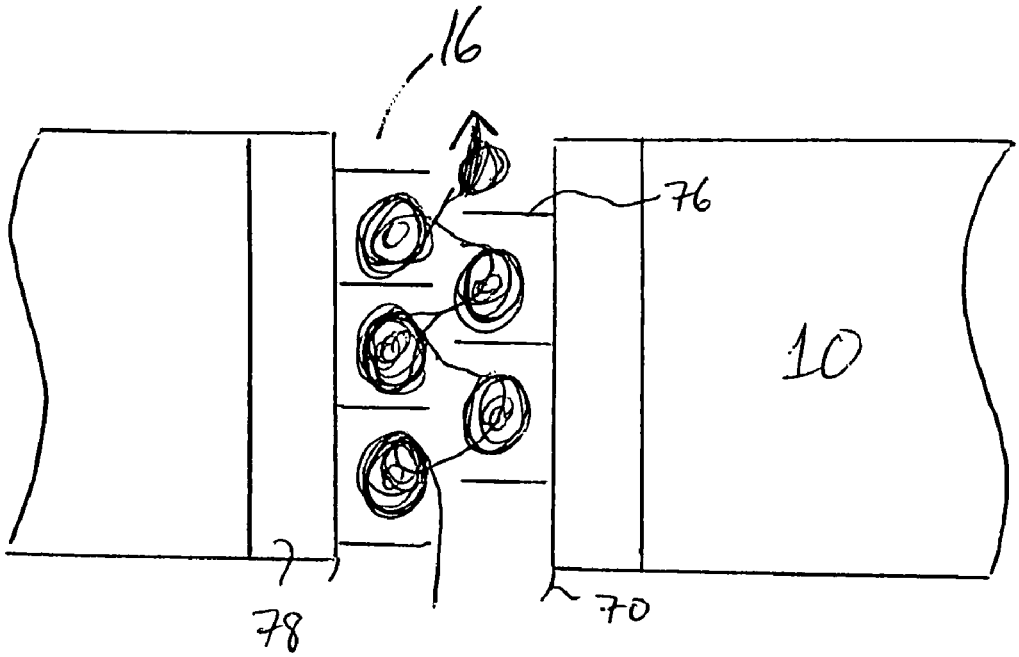

As shown in FIG. 4*a* and FIG. 4*b* in one embodiment, the flow-restricted holes 16 have a supply line or entrance 70 with a flow restrictor 78 in the supply line 70. The flow restrictor 78 may be integral with or removable from cylinder 10. Flow restrictor 78 in this embodiment includes a plurality of opposing fins 76 with tips forming a clearance d, thus forming a free flow channel when no vortices are present. When a blanket sleeve 12 is placed over the hole 16, as shown in FIG. 4*a*, a back pressure is created so that an even flow of air through the restrictor 78 results, thus providing pressure to the inside of blanket 12 and aiding in inflating the blanket 12.

As the blanket 12 is pulled in work side direction 2 for removal, the holes 16 are uncovered as shown in FIG. 4*b*. Since no back pressure blocks the air flow through restrictor 78, as the air speed increases the fins 76 create vortices which block most of the air flow through the restrictor 78, thus preserving air pressure in line 90 created by compressor 80 (FIG. 1).

All of the holes away from the work side holes have the restrictors 78. The work side holes 14 may or may not have the restrictors.

Figure 3:
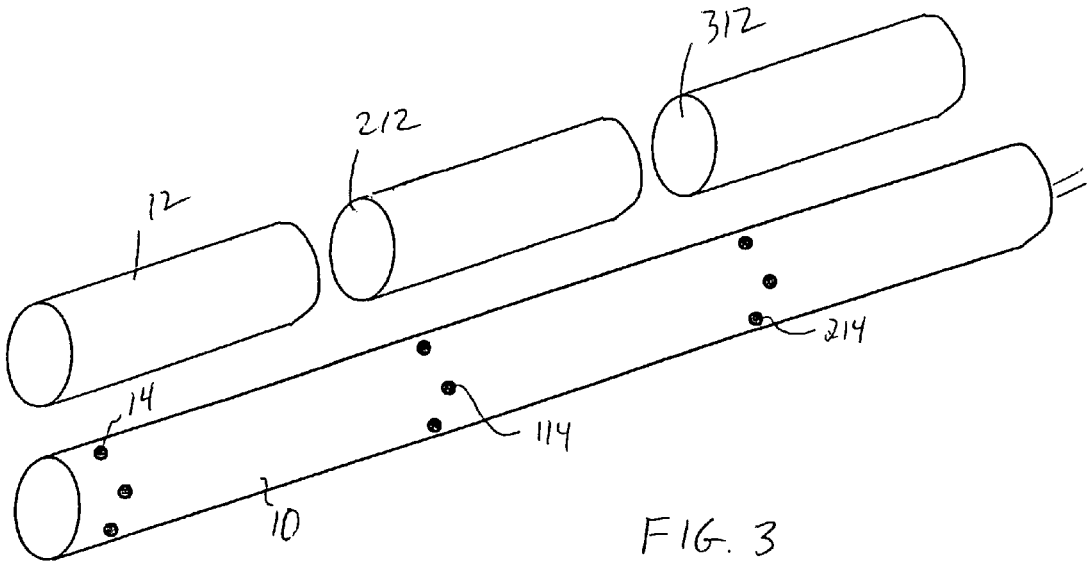
FIG. 3 shows a blanket cylinder for multiple blankets according to the present invention.

FIG. 3 shows a blanket cylinder 10 for multiple sleeve-shaped blankets 12, 212, 312, show schematically above the cylinder 10. To place the blankets 12, 212, 312 on cylinder 10, blanket 312 passes over work side holes 14, then passes over a second hole set 114 and comes to rest so that the work side end of blanket 312 is located over a third hole set 214. Blanket 212 is placed to rest next to blanket 312 with the work side end of blanket 212 over the second hole set 114. Blanket 12 rests at the work side end over holes 14. All of the holes in this embodiment may have flow restrictors. Additional holes with flow restrictors also could be placed between the hole sets 14, 114 and 214.

FIGS. 5 through 9 shows further embodiments of a restrictor 60 located in a space 50 between the outer surface of cylinder 10 and a second inner layer 65 of cylinder 10.

Figure 5:
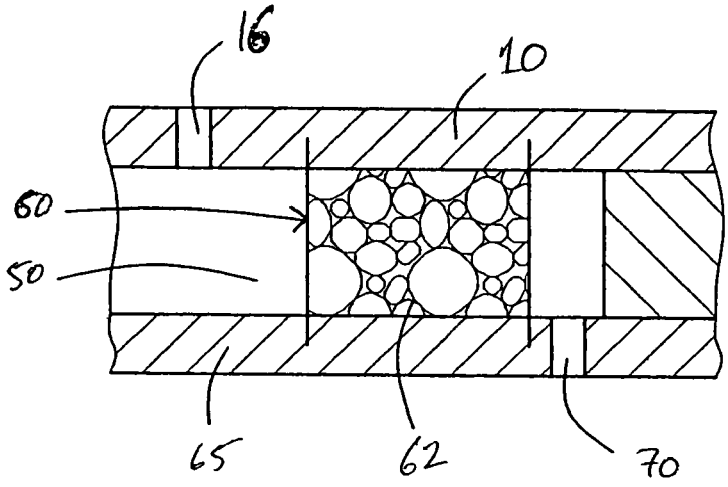
FIG. 5 shows another embodiment of the flow restrictor of the cylinder of the present invention.

The restrictor 60 in the embodiment of FIG. 5 includes gravel or other three-dimensional objects 63 in an air or fluid supply 70 prior to exit hole 16.

Figure 6:
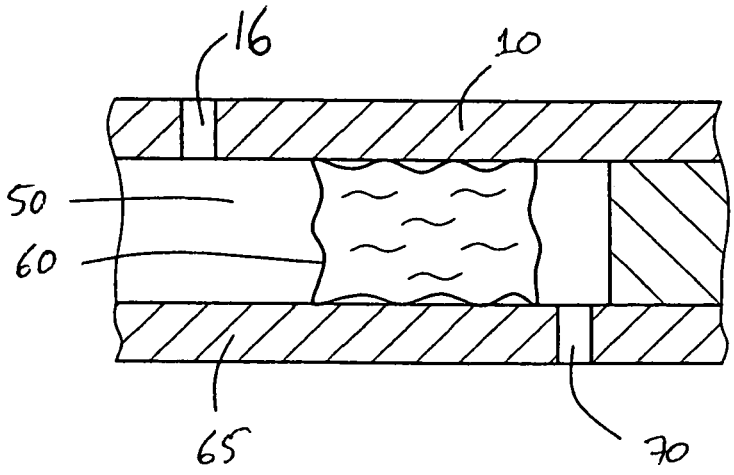
FIG. 6 shows yet another embodiment of the flow restrictor of the cylinder of the present invention.

FIG. 6 shows another embodiment with a textile restrictor 60, such as one made of fleece or a web-like material.

Figure 7A:
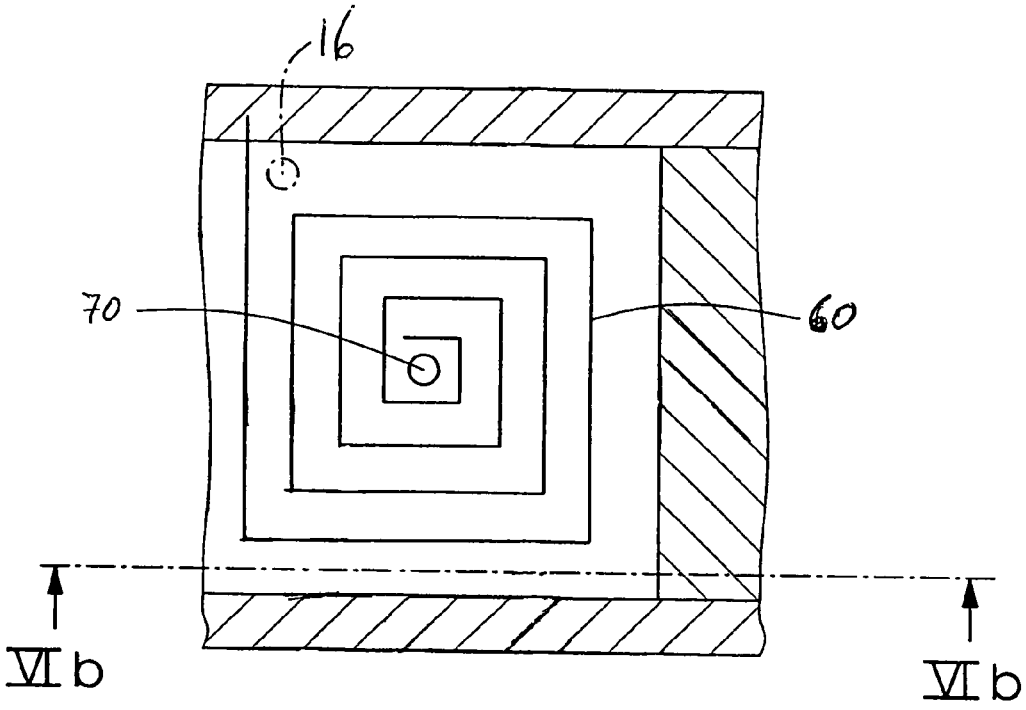
FIGS. 7*a* and 7*b* show in top view and side view a further embodiment of the flow restrictor of the cylinder of the present invention, with FIG. 7*a* showing the view through cut VIa—VIa of FIG. 7*b,* and FIG. 7*b* showing the view through cut VIb—VIb of FIG. 7*a.*
Figure 7B:
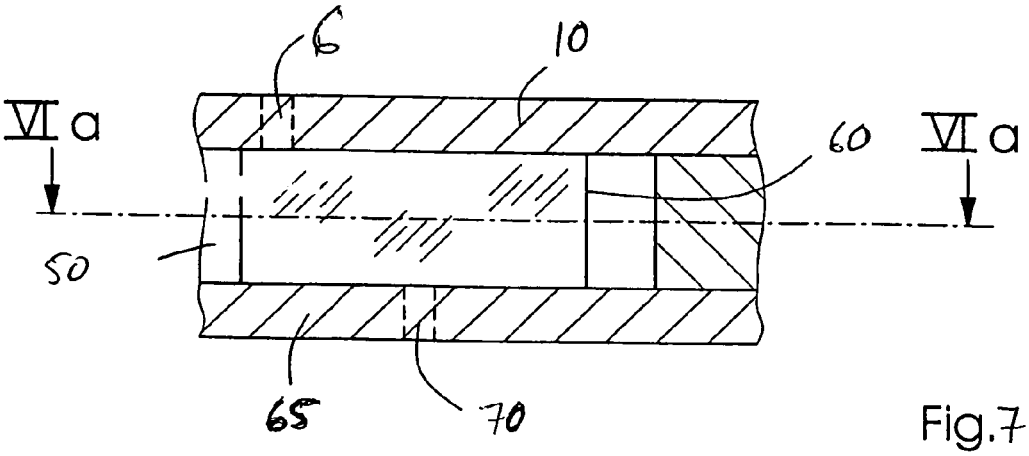

FIGS. 7*a* and 7*b* show a top and side view, respectively, of a maze shaped restrictor 60 in space 50. During unrestricted fluid flow with no back pressure generated by the sleeve, vortices can form in the corners of the maze.

Figure 8A:
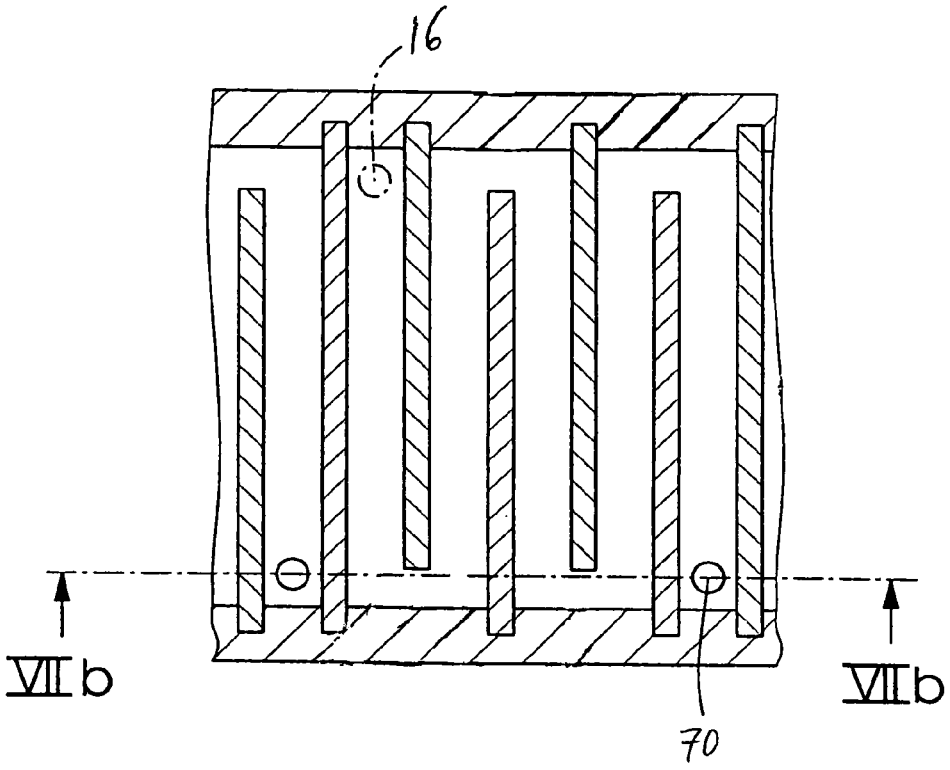
FIGS. 8*a* and 8*b* show in top view and side view another embodiment of the flow restrictor of the cylinder of the present invention, with FIG. 8*a* showing the view through cut VIIa—VIIa of FIG. 8*b*, and FIG. 8*b* showing the view through cut VIIb—VIIb of FIG. 8*a.*
Figure 8B:
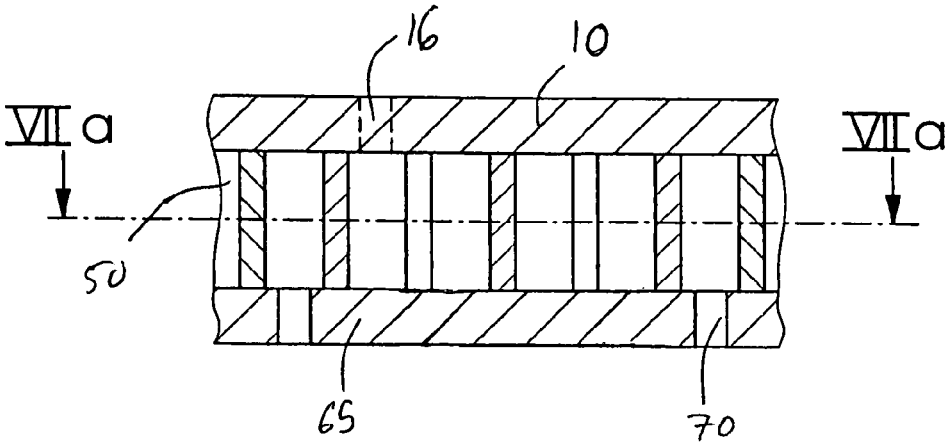

FIGS. 8*a* and 8*b* show a top and side view of another maze shaped restrictor 60 located in space 50.

Figure 9:
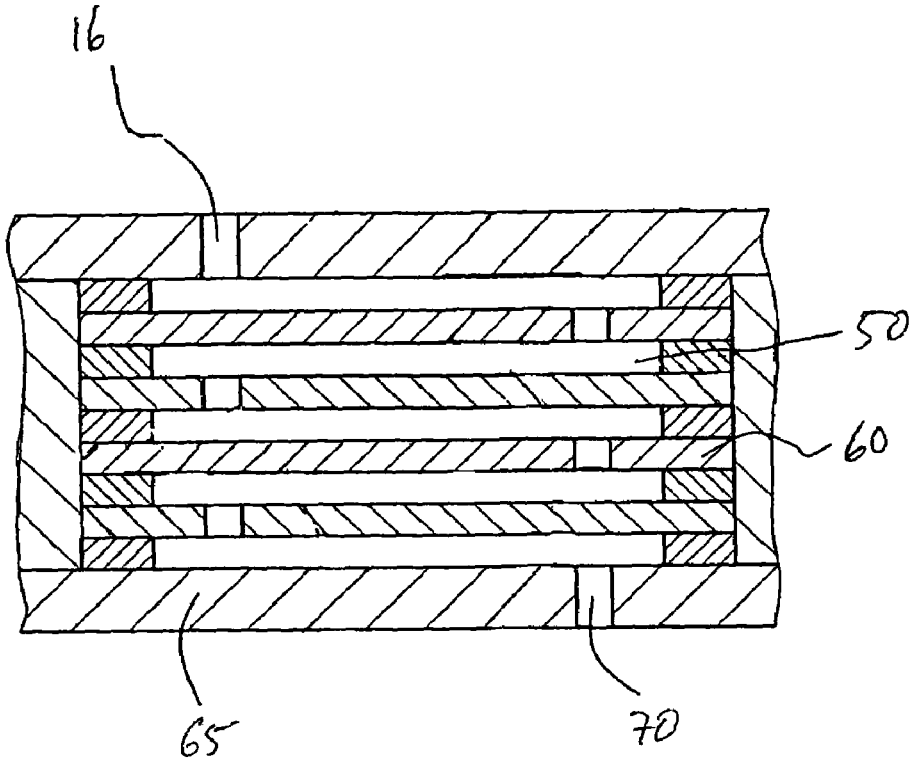
FIG. 9 shows another embodiment of the flow restrictor of the cylinder of the present invention.

FIG. 9 shows a sandwich-shaped restrictor 60 in space 50 with holes alternating on various sides of the sandwich leaves.

The restrictors may be integral with the cylinder or may be designed as inserts which can be pushed or screwed into existing holes in a printing cylinder. This permits easier manufacturing of new cylinders and also easier retrofitting of existing cylinders. The restrictors may be made of plastic or metal. Other shapes for the restrictors, such as square or triangular-shaped fins 76 in FIG. 4, could be used.

While air is a preferred fluid for aiding in sleeve removal, other fluids could be used.

The present invention, while described with respect to the preferred embodiment for use with a blanket sleeve, could be used with other types of printing sleeves, such as flexographic sleeves or lithographic plate cylinder sleeves.

The present invention has particular advantages when used with a printing press having a plurality of printing cylinder supplied by a single pressure source. The pressure from the pressure source can thus be maintained at a sufficient level, even as various blankets or other sleeves are removed.

What is claimed is:

1. A printing cylinder for accepting an axially-removable printing sleeve comprising:

a cylinder body having an outer surface, the outer surface having at least one hole; and a supply line in the cylinder body for supplying fluid to the at least one hole, the supply line having at least one flow restrictor altering fluid flow as a function of the at least one hole being covered by an axially-removable printing sleeve, the flow restrictor providing a first even fluid flow when the at least one hole is covered and a second different blocked air flow when the hole is uncovered.

2. The printing cylinder as recited in claim 1 wherein the fluid is air.

3. The printing cylinder as recited in claim 1 wherein the flow restrictor creates vortices when the at least one hole in uncovered.

4. The printing cylinder as recited in claim 1 wherein the cylinder body has a work side end and a gear side end, the outer surface having a plurality of other holes located axially between the at least one hole and the work side end.

5. The printing cylinder as recited in claim 4 wherein the plurality of other holes include another supply line having at least one other flow restrictor for the other holes.

6. The printing cylinder as recited in claim 1 wherein the flow restrictor includes a plurality of opposing fins, tips of opposing fins being spaced so as to form a free-flow channel.

7. The printing cylinder as recited in claim 1 wherein the cylinder body has a work side end and a gear side end the at least one hole being spaced closer to the gear side end than the work side end.

8. The printing cylinder as recited in claim 1 wherein the at least one hole includes a plurality of holes and the at least one flow restrictor includes a flow restrictor for each hole.

9. The printing cylinder as recited in claim 8 wherein the outer surface has a second set of holes for a second axially-removable printing sleeve, the second set of holes having second flow restrictors.

10. The printing cylinder as recited in claim 1 wherein the printing cylinder is a blanket cylinder.

11. A printing press comprising:

a first printing cylinder having at least one external hole and a first flow restrictor;

a first axially removable printing sleeve fitting over the first printing cylinder;

an additional printing cylinder having at least one second external hole and a second flow restrictor;

an additional axially removable printing sleeve fitting over the additional printing cylinder; and a fluid supply source for supplying pressure to the first and second external holes;

the first flow restrictor restricting flow through the external hole as a function of an axial position of the first printing sleeve with respect to the first printing cylinder and the second flow restrictor restricting flow through the second external hole as a function of an other axial position of the additional printing sleeve with respect to the additional printing cylinder.

12. The printing press as recited in claim 11 wherein no valves are located between the first and second external holes.

13. The printing press as recited in claim 11 wherein the first printing cylinder is a blanket cylinder.

14. The printing press as recited in claim 11 wherein the printing press is an offset lithographic printing press.

15. A printing press comprising:

a printing cylinder having an outer surface with at least one first external hole with a first flow restrictor, and at least one second external hole with a second flow restrictor, a first axially removable printing sleeve fitting over the printing cylinder so as to cover the at least one first external hole; and a second axially removable printing sleeve fitting over the printing cylinder so as to cover the at least one second external hole.

16. A method for axially removing a printing sleeve over a printing cylinder, the printing cylinder having a work side end and a gear side end and having holes at a work side end and having other holes between the holes at the work side end and the gear side end comprising the steps of:

applying fluid pressure to an inside of a printing sleeve located on a printing cylinder through the holes and through the other holes;

sliding the printing sleeve in a direction of the work side end of the printing cylinder; and automatically restricting flow through the other holes when the printing sleeve no longer is located over the other holes.

17. The method as recited in claim 16 wherein the automatically restricting step includes forming vortices in a supply line for the other holes.

18. The method as recited in claim 16 wherein the printing sleeve is a blanket.

19. The method as recited in claim 16 further comprising sliding an additional printing sleeve in the direction of the work side end.

20. A printing cylinder for accepting an axially-removable printing sleeve comprising:

a cylinder body having an outer surface, the outer surface having at least one hole; and a supply line in the cylinder body for supplying fluid to the at least one hole, the supply line having at least one flow restrictor altering fluid flow as a function of the at least one hole being covered by an axially-removable printing sleeve, wherein the flow restrictor includes a plurality of opposing fins, tips of opposing fins being spaced so as to form a free-flow channel.

* * * * *